US008616612B2

(12) United States Patent
Quinn et al.

(10) Patent No.: US 8,616,612 B2
(45) Date of Patent: Dec. 31, 2013

(54) CLOSURE ASSEMBLY HAVING MULTI STAGE STRIKER ASSEMBLY

(75) Inventors: Shawn G. Quinn, Grand Blanc, MI (US); Michael E. McGuire, Milford, MI (US); Scott W. Thorpe, Milford, MI (US); Altaf S. Imam, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 222 days.

(21) Appl. No.: 13/198,327

(22) Filed: Aug. 4, 2011

(65) Prior Publication Data

US 2013/0031844 A1 Feb. 7, 2013

(51) Int. Cl.
*E05B 15/02* (2006.01)

(52) U.S. Cl.
USPC ..... 296/146.9; 292/340; 292/341.12; 292/DIG. 3

(58) Field of Classification Search
USPC ..... 296/146.1, 146.5, 146.6, 146.8, 146.9, 296/155; 49/503; 292/1, 13, 80, 84, 137, 292/145, 216, 340, 341.11, 341.12, 341.13, 292/341.15, 341.17, 341.18, 342, DIG. 3, 292/DIG. 55, DIG. 56, DIG. 61, DIG. 73
See application file for complete search history.

(56) References Cited

U.S. PATENT DOCUMENTS 7,029,043 B2 * 4/2006 Fisher
2007/0114802 A1 * 5/2007 Ishihara et al.

* cited by examiner

*Primary Examiner* — Glenn Dayoan
*Assistant Examiner* — Jason S Daniels
(74) *Attorney, Agent, or Firm* — Quinn Law Group, PLLC

(57) ABSTRACT

A closure assembly for securing a moveable panel relative to a body of a vehicle includes a striker assembly and a latch mechanism. The striker assembly includes a biasing mechanism that, when engaged by the latch mechanism, simultaneously biases the latch mechanism in a lateral direction and an axial direction to dampen movement of the latch mechanism relative to the striker assembly. The biasing mechanism provides dual damping rates.

18 Claims, 2 Drawing Sheets

CLOSURE ASSEMBLY HAVING MULTI STAGE STRIKER ASSEMBLY

TECHNICAL FIELD

The invention generally relates to a closure assembly for securing a moveable panel, such as a liftgate, a decklid, or a hatch, to a body of a vehicle.

BACKGROUND

Vehicles include moveable panels for sealing openings in a body of the vehicle. The moveable panels may be but are not limited to a liftgate for sealing a rear opening of a Sport Utility Vehicle (SUV), a decklid for sealing a trunk space of a sedan, or a hatch for sealing a rear opening of a hatchback. It should be appreciated that the opening and the moveable panel may be located anywhere on the vehicle, and may be positioned in any suitable orientation.

A closure assembly secures the moveable panel relative to the body of the vehicle. The closure assembly includes a striker assembly and a latch mechanism. Typically, the striker assembly is attached to the body, and the latch mechanism is attached to and moveable with the panel. However, the relative positions of the striker assembly and the latch mechanism may be reversed, with the latch mechanism attached to the body and the striker assembly attached to and moveable with the panel. The striker assembly includes a wire striker, which generally forms a loop. The panel and the latch mechanism move along a path into and out of engagement with the striker assembly. The latch mechanism engages the wire striker of the striker assembly in interlocking engagement to secure the panel relative to the body. The interlocking engagement between the striker assembly and the latch mechanism must minimize and/or eliminate movement of the panel in both a lateral direction and/or a fore-aft direction to prevent undesirable noise, paint chips, and the structural feel of the panel.

SUMMARY

A closure assembly for securing a moveable panel relative to a body of a vehicle is provided. The closure assembly includes a striker assembly and a latch mechanism. The striker assembly includes a wire striker. The latch mechanism is moveable along a path between a closed position and an open position. When in the closed position, the latch mechanism is configured for engaging the wire striker in interlocking engagement to secure the latch mechanism relative to the striker assembly. When in the open position, the latch mechanism is configured for not engaging the wire striker in interlocking engagement to allow movement along the path of the latch mechanism relative to the striker assembly. The striker assembly includes a biasing mechanism. When the latch mechanism is disposed in the closed position in interlocking engagement with the wire striker, the biasing mechanism is configured for simultaneously biasing the latch mechanism in a lateral direction relative to the path of the latch mechanism, and in an axial direction along the path of the latch mechanism to dampen movement of the latch mechanism relative to the striker assembly.

A vehicle is also provided. The vehicle includes a body that defines an opening, and a panel that is moveably attached to the body for selectively sealing the opening. A closure assembly secures the panel relative to the body. The closure assembly includes a striker assembly and a latch mechanism. The striker assembly includes a wire striker. The latch mechanism is moveable along a path between a closed position and an open position. When in the closed position, the latch mechanism engages the wire striker in interlocking engagement to secure the latch mechanism relative to the striker assembly. When in the open position, the latch mechanism does not engage the wire striker in interlocking engagement, thereby allowing movement of the latch mechanism relative to the striker assembly along the path. The striker assembly includes a biasing mechanism. The biasing mechanism includes a first portion and a second portion. The first portion is disposed opposite the second portion on opposing lateral sides of the path of the latch mechanism. The wire striker is disposed between the first portion and the second portion. The first portion of the biasing mechanism includes a first arm, and the second portion of the biasing mechanism includes a second arm opposing the first arm. The first arm and the second arm are flexible in response to movement of the latch mechanism along the path to generate a bias force within each of the first arm and the second arm. The bias force within each of the first arm and the second arm simultaneously biases the latch mechanism in a lateral direction relative to the path of the latch mechanism and an axial direction along the path of the latch mechanism to dampen movement of the latch mechanism relative to the striker assembly.

A striker assembly for engaging a latch mechanism of a vehicle is also provided. The striker assembly includes a base, and a wire striker attached to the base. A biasing mechanism is configured for simultaneously biasing the latch mechanism in a lateral direction relative to a path of the latch mechanism and an axial direction along the path of the latch mechanism to dampen movement of the latch mechanism. The biasing mechanism includes a first portion and a second portion. The first portion includes a first damping block that is fixedly attached to the base, and a first spring arm that is attached to the base for flexible movement about a first axis. The second portion includes a second damping block that is fixedly attached to the base, and a second spring arm that is attached to the base for flexible movement about a second axis. The first spring arm is independently flexible relative to the second spring arm. The first spring arm and the first damping block are disposed opposite the second spring arm and the second damping block respectively, on opposing lateral sides of an axis of the wire striker, with the wire striker disposed between the first spring arm and the second spring arm. The first spring arm and the second spring arm are flexible inward to generate a bias force. The bias force is configured for biasing the latch mechanism in the lateral direction and the axial direction. The first damping block and the second damping block are configured for engaging the first spring arm and the second spring arm respectively in response to the first spring arm and the second spring arm flexing beyond a predetermined limit. The first spring arm includes a first damping pad that is configured for engaging the latch mechanism to dampen movement of the latch mechanism. The second spring arm includes a second damping pad that is configured for engaging the latch mechanism to dampen the movement of the latch mechanism.

Accordingly, the first portion and the second portion of the biasing mechanism biases against the latch mechanism in opposing lateral directions to offset each other and minimize and/or eliminate any lateral movement of the latch mechanism relative to the striker assembly. Furthermore, the first portion and the second portion of the biasing mechanism operate together to bias against the latch mechanism in an axial direction, along the path of the latch mechanism, to maintain a constant pressure between the latch mechanism and the wire striker, thereby minimizing and/or eliminating any axial movement of the latch mechanism along the path of the latch mechanism. The first damping block and the second damping block provide a second damping rate to further dampen movement of the latch mechanism should the latch mechanism cause the first arm or the second arm to flex inward beyond a pre-determined limit.

The above features and advantages and other features and advantages of the present invention are readily apparent from the following detailed description of the best modes for carrying out the invention when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the invention, as defined by the appended claims.

Referring to the Figures, wherein like numerals indicate like parts throughout the several views, a vehicle is generally shown at 20. The vehicle 20 includes a body 22 that defines an opening 24. The opening 24 may include, for example, a rear access to a cargo van or a sport utility vehicle 20, or a trunk to a sedan. It should be appreciated that the opening 24 may be located and oriented in any position on the body 22 of the vehicle 20. A panel 26 is moveably attached to the body 22, for example, by one or more hinges. The panel 26 moves between an open position to allow access to the opening 24, and a closed position to selectively seal the opening 24.

Figure 1:
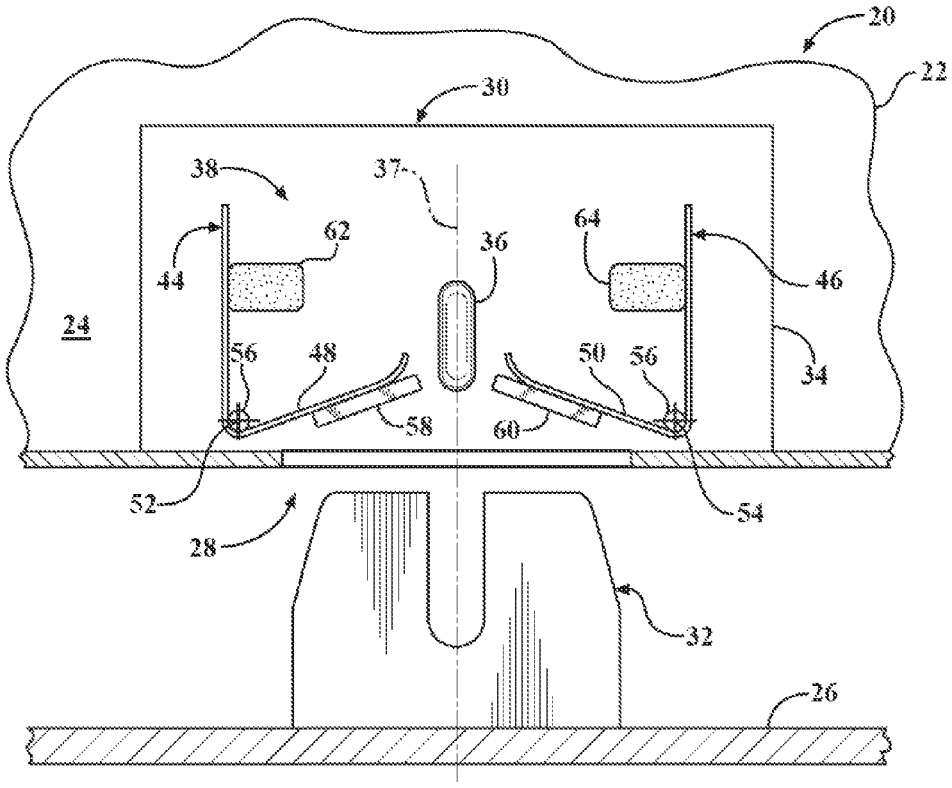
FIG. 1 is a schematic plan view of a vehicle showing a closure assembly in an open position.
Figure 2:
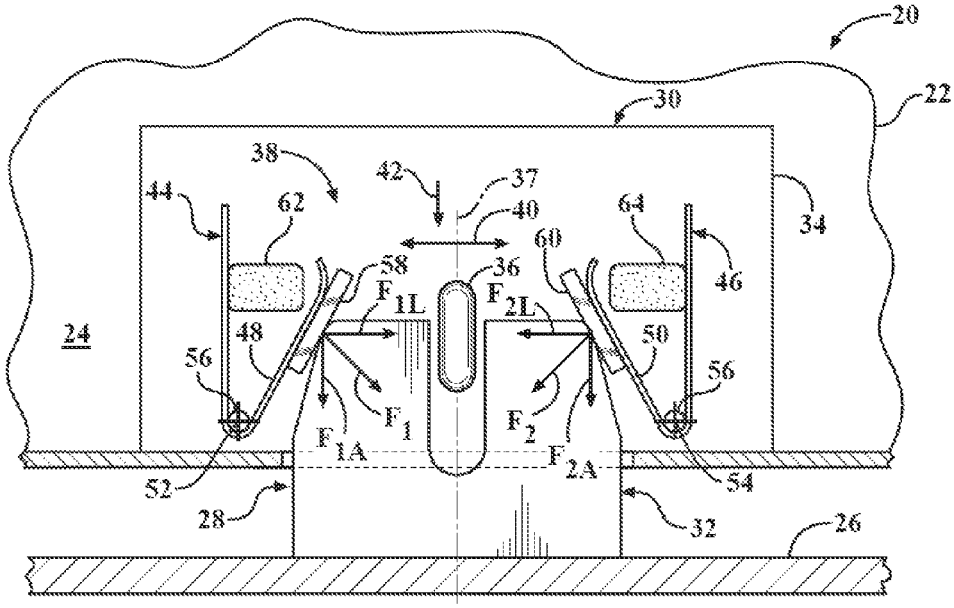
FIG. 2 is a schematic plan view of the vehicle showing the closure assembly in a closed position with a biasing mechanism providing a first rate of damping resistance.
Figure 3:
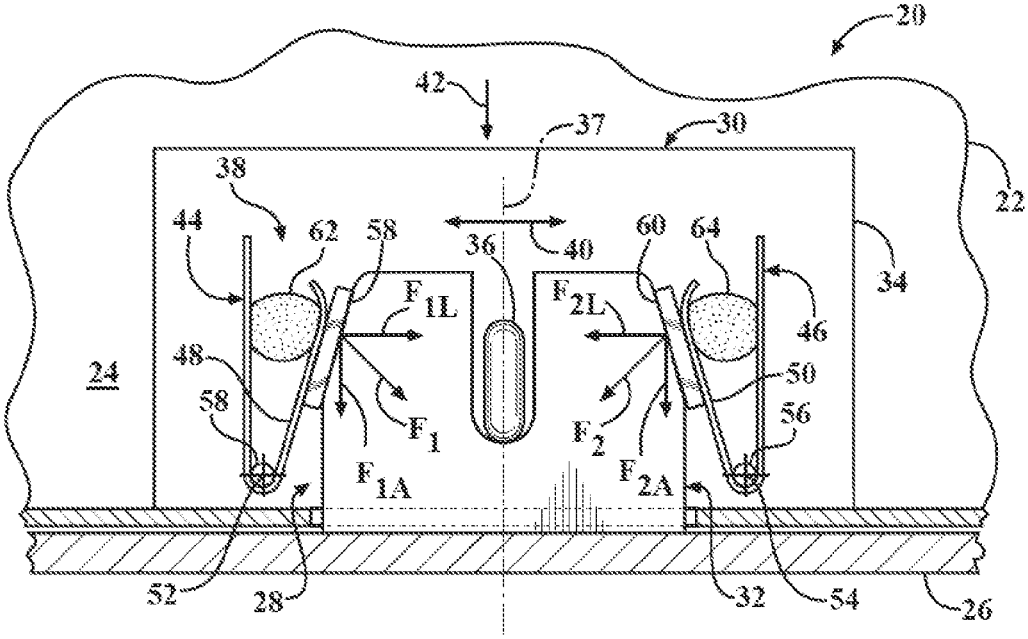
FIG. 3 is a schematic plan view of the vehicle showing the closure assembly in a closed position with the biasing mechanism providing a second rate of damping resistance.

A closure assembly 28 secures the panel 26 relative to the body 22 in the closed position. The closure assembly 28 includes a striker assembly 30 and a latch mechanism 32. The striker assembly 30 includes a base 34 supporting a wire striker 36. The wire striker 36 may define a loop as is known. As shown, the striker assembly 30 is attached to the body, and the latch mechanism 32 attached to and moves with the panel 26 along a path 37, between the closed position and the open position. However, it should be appreciated that the relative positions of the striker assembly 30 and the latch mechanism 32 may be reversed, with the latch mechanism 32 attached to the body, and the striker assembly attached to and moveable with the panel 26. The path 37 is generally aligned along a longitudinal axis of the wire striker 36. As shown in FIGS. 2 and 3, the latch mechanism 32 engages the wire striker 36 in interlocking engagement to secure the latch mechanism 32 relative to the striker assembly. When the latch mechanism 32 and the panel 26 are in the open position, such as shown in FIG. 1, the latch mechanism 32 does not engage the wire striker 36 in interlocking engagement, i.e., the latch mechanism 32 is disengaged from the interlocking engagement with the wire striker 36, to allow movement of the latch mechanism 32 and the panel 26 relative to the striker assembly. The latch mechanism 32 and wire striker 36 may include any suitable combination, and/or configuration known to those skilled in the art and/or capable of securely latching the panel 26 to the body 22. Accordingly, the specifics of the wire striker 36, the latch mechanism 32, and the operation of the interlocking engagement therebetween are not described in detail herein.

The striker assembly 30 includes a biasing mechanism 38. When the latch mechanism 32 is disposed in the closed position in interlocking engagement with the wire striker 36, the biasing mechanism 38 simultaneously biases the latch mechanism 32 in a lateral direction relative to the path 37 of the latch mechanism 32, i.e., substantially perpendicular to the path 37, and an axial direction along the path 37 of the latch mechanism 32, i.e., longitudinally along or parallel with the path. The lateral direction is generally indicated by the direction arrow 40 shown in FIGS. 2 and 3, and the axial direction is generally indicated by the direction arrow 42 shown in FIGS. 2 and 3. The biasing mechanism 38 biases the latch mechanism 32 in the lateral direction and the axial direction to dampen movement of the latch mechanism 32 relative to the striker assembly.

The biasing mechanism 38 includes a first portion 44 and a second portion 46. The base 34 of the striker assembly 30 supports the first portion 44 and the second portion 46 relative to the latch mechanism 32. The base 34 is configured for attachment to the vehicle 20, and secures the wire striker 36 and the biasing mechanism 38 to the vehicle 20, with the panel 26 and the latch mechanism 32 moveable along the path 37 relative thereto. The first portion 44 is disposed opposite the second portion 46 on opposing lateral sides of the path 37 of the latch mechanism 32. The wire striker 36 is disposed between the first portion 44 and the second portion 46.

The first portion 44 of the biasing mechanism 38 includes a first arm 48, and the second portion 46 of the biasing mechanism 38 includes a second arm 50. The second arm 50 opposes the first arm 48. The first arm 48 is attached to the base 34 and is flexible about a first axis 52. The second arm 50 is attached to the base 34 and is flexible about a second axis 54. The first arm 48 and the second arm 50 are independently flexible relative to each other. The first arm 48 and the second arm 50 are flexible in response to movement of the latch mechanism 32 along the path 37. Accordingly, as the latch mechanism 32 moves along the path 37, the latch mechanism 32 engages the first arm 48 and/or the second arm 50, causing the first arm 48 and/or the second arm 50 to flex inward along the path 37. The flexure of the first arm 48 and the second arm 50 generates a bias force within each of the first arm 48 and the second arm 50 independently of each other. The bias force of the first arm 48 and the second arm 50 simultaneously biases the latch mechanism 32 in the lateral direction and the axial direction to dampen movement of the latch mechanism 32 relative to the striker assembly.

Referring to FIGS. 2 and 3, the bias force $F_1$ of the first arm 48 is directed toward the latch mechanism 32 at an angle relative to the path 37 of the latch mechanism 32. As such, the bias force $F_1$ of the first arm 48 includes a lateral component $F_{1L}$ and an axial component $F_{1A}$. The lateral component $F_{1L}$ of force $F_1$ biases the latch mechanism 32 in the lateral direction, and the axial component $F_{1A}$ of force $F_1$ biases the latch mechanism 32 in the axial direction. Similarly, the bias force $F_2$ of the second arm 50 is also directed toward the latch mechanism 32 at an angle relative to the path 37 of the latch mechanism 32. As such, the bias force $F_2$ of the first arm 48 includes a lateral component $F_{2L}$ and an axial component $F_{2A}$. The lateral component $F_{2L}$ of force $F_2$ biases the latch mechanism 32 in the lateral direction, opposite and against lateral force $F_{1L}$, and the axial component $F_{2A}$ of force $F_2$ biases the latch mechanism 32 in the axial direction, in combination or addition to axial force $F_{1A}$. Accordingly, it should be appreciated that when the latch mechanism 32 first contacts the first arm 48 and the second arm 50, the axial components of the bias forces $F_1$ and $F_2$ are greater than the lateral components of the bias forces $F_1$ and $F_2$. However, as the latch mechanism 32 moves further inward along the path 37, thereby flexing the first arm 48 about the first axis 52 and the second arm 50 about the second axis 54, the axial components of the bias forces $F_1$ and $F_2$ decrease, and the lateral components of the bias forces $F_1$ and $F_2$ increase. Furthermore, it should be appreciated that if the latch mechanism 32 is centered between the first arm 48 and the second arm 50, the bias forces $F_1$ and $F_2$ are substantially equal in magnitude. However, if the latch mechanism 32 should move closer to one of the first portion 44 or the second portion 46 of the biasing mechanism 38, the magnitude of the bias forces $F_1$ and $F_2$ will differ. For example, if the latch mechanism 32 moves closer to the first arm 48, thereby flexing the first arm 48 more than the second arm 50, the magnitude of the bias force $F_1$ will be greater than the magnitude of the bias force $F_2$, thereby operating to center the latch mechanism 32 between the first portion 44 and the second portion 46 of the biasing mechanism 38.

The first arm 48 and the second arm 50 each include a spring 56 to generate the bias force. For example, the first arm 48 and the second arm 50 may each include a piece of spring 56 steel attached to the base 34 at the first axis 52 and the second axis 54 respectively. Alternatively, the first arm 48 and the second arm 50 may each include a coil spring 56 interconnecting the first arm 48 and the second arm 50 to the base 34. It should be appreciated that the first arm 48 and the second arm 50 may be configured and attached to the base 34 in any manner capable of allowing the first arm 48 and the second arm 50 to generate the bias forces $F_1$ and $F_2$ when engaged and flexed inward by the latch mechanism 32.

The first portion 44 may further include a first damping pad 58 attached to the first arm 48. The first damping pad 58 is configured for engaging, i.e., contacting, the latch mechanism 32. The second portion 46 may further include a second damping pad 60 attached to the second arm 50. The second damping pad 60 is configured for engaging, i.e., contacting, the latch mechanism 32. The first damping pad 58 and the second damping pad 60 assist to dampen the movement of the latch mechanism 32 relative to the first arm 48 and the second arm 50 respectively. The first damping pad 58 and the second damping pad 60 may include an elastomeric material, including but not limited to a rubber material, or may alternatively include some other material capable of damping the movement between the first arm 48 and the latch mechanism 32, and the second arm 50 and the latch mechanism 32.

The first portion 44 may further include a first damping block 62. The first damping block 62 is attached to the base 34 in a fixed position relative to the first axis 52. As shown in FIG. 3, the first damping block 62 engages the first arm 48 in response to the first arm 48 flexing inward beyond a predetermined limit to provide additional damping resistance to the movement of the latch mechanism 32 along the path 37 of the latch mechanism 32. Similarly, the second portion 46 may further include a second damping block 64. The second damping block 64 is attached to the base 34 in a fixed position relative to the second axis 54. As shown in FIG. 3, the second damping block 64 engages the second arm 50 in response to the second arm 50 flexing inward beyond a pre-determined limit to provide additional damping resistance to the movement of the latch mechanism 32 along the path 37 of the latch mechanism 32. The first damping block 62 and the second damping block 64 may include but is not limited to a viscoelastic material, or may alternatively include some other material capable of damping the movement of the first arm 48 and the second arm 50 beyond their respective pre-determined limits. Furthermore, the first damping block 62 and the second damping block 64 may alternatively include a damping mechanism, such as but not limited to a hydraulic damper, a pneumatic damper, a coil spring, or some other similar mechanism capable of damping the movement of the first arm 48 and the second arm 50 beyond their respective pre-determined limits.

As shown in FIG. 2, the first arm 48 and the second arm 50 provide a first damping rate to resist movement of the latch mechanism 32 along the path 37 of the latch mechanism 32. The first damping rate is the bias force provided by the first arm 48 and the second arm 50. If the latch mechanism 32 moves further inward, thereby flexing the first arm 48 and/or the second arm 50 backward into engagement with the first damping block 62 and the second damping block 64 respectively, then the first damping block 62 and/or the second damping block 64 operate to provide a second damping rate, as shown in FIG. 3. The second damping rate is the bias force provided by the first arm 48, the second arm 50, the first damping block 62 and/or the second damping block 64.

While the best modes for carrying out the invention have been described in detail, those familiar with the art to which this invention relates will recognize various alternative designs and embodiments for practicing the invention within the scope of the appended claims.

The invention claimed is:

1. A closure assembly for securing a moveable panel relative to a body of a vehicle, the closure assembly comprising:

a striker assembly having a wire striker; and a latch mechanism moveable along a path between a closed position configured for engaging the wire striker in interlocking engagement to secure the latch mechanism relative to the striker assembly, and an open position configured for not engaging the wire striker in interlocking engagement to allow movement along the path of the latch mechanism relative to the striker assembly;

wherein the striker assembly includes a biasing mechanism configured for simultaneously biasing the latch mechanism in a lateral direction relative to the path of the latch mechanism and an axial direction along the path of the latch mechanism when the latch mechanism is disposed in the closed position in interlocking engagement with the wire striker to dampen movement of the latch mechanism relative to the striker assembly;

wherein the biasing mechanism includes a first portion and a second portion, wherein the first portion is disposed opposite the second portion on opposing lateral sides of the path of the latch mechanism, with the wire striker disposed between the first portion and the second portion; and wherein each of the first portion and the second portion includes an arm flexible in response to movement of the latch mechanism, wherein the flexure of the arms of the first portion and the second portion generates a bias force in each of the arms respectively that biases the latch mechanism in the lateral direction and the axial direction.

2. A closure assembly as set forth in claim 1 wherein the arm of the first portion is independently flexible relative to the arm of the second portion.

3. A closure assembly as set forth in claim 2 wherein each arm of the first portion and the second portion includes a spring.

4. A closure assembly as set forth in claim 1 wherein each of the first portion and the second portion includes a damping pad attached to the arms of the first portion and the second portion respectively, wherein the damping pad of the first portion and the second portion are configured for engaging the latch mechanism and damping movement of the latch mechanism.

5. A closure assembly as set forth in claim 4 wherein the damping pad of the first portion and the second portion includes an elastomeric material.

6. A closure assembly as set forth in claim 4 wherein each of the first portion and the second portion includes a damping block configured for engaging the arms of the first portion and the second portion respectively in response to the arms of the first portion and the second portion flexing beyond a pre-determined limit, and for damping movement of the latch assembly.

7. A closure assembly as set forth in claim 6 wherein the arm of the first portion and the second portion provide a first damping rate for damping movement of the latch mechanism, and wherein the damping block of the first portion and the second portion provide a second damping rate for damping movement of the latch mechanism.

8. A closure assembly as set forth in claim 6 wherein the damping block of the first portion and the second portion includes a viscoelastic material.

9. A closure assembly as set forth in claim 6 wherein the striker assembly includes a base supporting the first portion and the second portion relative to the latch mechanism and configured for attachment to the vehicle.

10. A closure assembly as set forth in claim 9 wherein the arm of the first portion is attached to the base and flexible about a first axis, and wherein the arm of the second portion is attached to the base and flexible about a second axis.

11. A closure assembly as set forth in claim 10 wherein the damping block of the first portion is attached to the base in a fixed position relative to the first axis, and wherein the damping block of the second portion is attached to the base in a fixed position relative to the second axis.

12. A vehicle comprising:

a body defining an opening;

a panel moveably attached to the body for selectively sealing the opening; and a closure assembly for securing the panel relative to the body, the closure assembly including:

a striker assembly having a wire striker;

a latch mechanism moveable along a path between a closed position for engaging the wire striker in interlocking engagement to secure the latch mechanism relative to the striker assembly, and an open position for not engaging the wire striker in interlocking engagement to allow movement of the latch mechanism relative to the striker assembly along the path;

wherein the striker assembly includes a biasing mechanism having a first portion and a second portion, with the first portion and the second portion disposed on opposing lateral sides of the path of the latch mechanism, and the wire striker disposed between the first portion and the second portion;

wherein the first portion of the biasing mechanism includes a first arm and the second portion of the biasing mechanism includes a second arm opposing the first arm, wherein the first arm and the second arm are flexible in response to movement of the latch mechanism along the path to generate a bias force within each of the first arm and the second arm to simultaneously bias the latch mechanism in a lateral direction relative to the path of the latch mechanism and an axial direction along the path of the latch mechanism to dampen movement of the latch mechanism relative to the striker assembly.

13. A vehicle as set forth in claim 12 wherein the first arm is independently flexible relative to the second arm.

14. A vehicle as set forth in claim 12 wherein the first arm and the second arm each includes a spring.

15. A vehicle as set forth in claim 12 wherein the first portion includes a first damping pad attached to the first arm, and the second portion includes a second damping pad attached to the second arm, wherein the first damping pad and the second damping pad are each configured for engaging the latch mechanism and damping movement of the latch mechanism.

16. A vehicle as set forth in claim 15 wherein the first portion includes a first damping block configured for engaging the first arm in response to the first arm flexing beyond a pre-determined limit to dampen movement of the latch assembly, and wherein the second portion includes a second damping block configured for engaging the second arm in response to the second arm flexing beyond a pre-determined limit to dampen movement of the latch assembly.

17. A vehicle as set forth in claim 15 wherein the first arm and the second arm cooperate to define a first damping rate, and wherein the first damping block and the second damping block cooperate to define a second damping rate to provide multi-stage damping of the latch mechanism in response to movement along the path of the latch mechanism.

18. A striker assembly for engaging a latch mechanism of a vehicle, the striker assembly comprising:

a base;

a wire striker attached to the base; and a biasing mechanism configured for simultaneously biasing the latch mechanism in a lateral direction relative to a path of the latch mechanism and an axial direction along the path of the latch mechanism to dampen movement of the latch mechanism, the biasing mechanism including:

a first portion having a first damping block fixedly attached to the base and a first spring arm attached to the base for flexible movement about a first axis;

a second portion having a second damping block fixedly attached to the base and a second spring arm attached to the base for flexible movement about a second axis;

wherein the first spring arm is independently flexible relative to the second spring arm;

wherein the first spring arm and the first damping block are disposed opposite the second spring arm and the second damping block respectively, on opposing lateral sides of an axis of the wire striker, with the wire striker disposed between the first spring arm and the second spring arm;

wherein the first spring arm and the second spring arm are flexible inward to generate a bias force configured for biasing the latch mechanism in the lateral direction and the axial direction;

wherein the first damping block and the second damping block are configured for engaging the first spring arm and the second spring arm respectively in response to the first spring arm and the second spring arm flexing beyond a pre-determined limit; and wherein the first spring arm includes a first damping pad configured for engaging the latch mechanism to dampen movement of the latch mechanism, and the second spring arm includes a second damping pad configured for engaging the latch mechanism to dampen the movement of the latch mechanism.

* * * * *